US006648380B1

(12) United States Patent
Szablewski et al.

(10) Patent No.: US 6,648,380 B1
(45) Date of Patent: Nov. 18, 2003

(54) DOOR LOCK, ESPECIALLY FOR MOTOR VEHICLES

(75) Inventors: Piotr Szablewski, Wuppertal (DE); Erik Kiehl, Ratingen (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 09/913,820

(22) PCT Filed: Feb. 17, 2000

(86) PCT No.: PCT/EP00/01284

§ 371 (c)(1),
(2), (4) Date: Oct. 10, 2001

(87) PCT Pub. No.: WO00/49253

PCT Pub. Date: Aug. 24, 2000

(30) Foreign Application Priority Data

Feb. 17, 1999 (DE) ..... 199 06 538
Dec. 18, 1999 (DE) ..... 199 61 247

(51) Int. Cl.[7] ..... E05C 3/06

(52) U.S. Cl. ..... 292/201; 292/DIG. 65; 292/216

(58) Field of Search ..... 292/201, 216, 292/DIG. 65; 70/264

(56) References Cited

U.S. PATENT DOCUMENTS 5,474,338 A * 12/1995 Buscher ..... 292/201
5,537,848 A * 7/1996 Grzanka ..... 70/279
5,584,515 A * 12/1996 Silye ..... 292/201
5,634,677 A * 6/1997 Buscher ..... 292/216
5,676,003 A * 10/1997 Ursel ..... 70/472
5,961,163 A * 10/1999 Brackmann ..... 292/201

FOREIGN PATENT DOCUMENTS

DE 195 05 779 A1 8/1996
DE 196 50 826 A1 6/1998
DE 197 25 416 C1 1/1999

* cited by examiner

*Primary Examiner*—Gary Estremsky
(74) *Attorney, Agent, or Firm*—Friedrich Kueffner

(57) ABSTRACT

A rotary latch (11) of a door lock is retained in a detent position by a spring-mounted retainer (20). A motor-driven working member (47) is provided for lifting said retainer (20). An energy-storing device (30) subjects a storing member (22) to a force and hereby serves to lift the retainer (20) out of its detent position in the rotary latch (11). To this end, the storing member (22) has a control surface against which the working member (47) travels in a first motor phase in order to load the energy-storing device (30). A counter-control surface (29) against which the working member (47) travels when lifting the retainer (20) in a staggered second motor phase is also provided. The aim of the invention is to provide a reliable door lock which will also function in the event of an accident. To this end, both the control surface (23) and the counter-control surface (29) are located on the storing member (22). The additional force required for lifting the retainer (20) acts on said retainer indirectly through the storing member (22). As a result, the quantities of energy produced one after the other in the two motor drive phases can be transmitted spontaneously from the shoulder (32) of the storing member (22) to the counter-shoulder (33) of the retainer (20).

16 Claims, 5 Drawing Sheets

DOOR LOCK, ESPECIALLY FOR MOTOR VEHICLES

BACKGROUND OF THE INVENTION

1. Field of the Invention

The invention relates to a door lock wherein the rotary latch receives in its one rotary end position, i.e., its locking position, a locking member which drops into a main catch and locks the retainer against its spring-load. In order to transfer the rotary latch into its open position, the retainer is released. For releasing the retainer, a motor-driven working member is used. The motor is activated, in the case of authorized access of the user, when, for example, an actuator belonging to the door lock is directly or indirectly actuated.

2. Discussion of Related Art

In a known door lock of this kind (DE 197 25 416 C1) a force storage device loads the arm of a storing member which is supported on the motor-driven working member and thus defines the charged state of the force storage device. This storing member has a shoulder which, for the purpose of lifting the retainer, impacts against a counter shoulder on an arm of the retainer in order to lift, in the normal situation as well as in a special situation, for example, in a crash, the retainer from its locking position in the rotary latch by releasing the force storage device. In this connection, the storing member has a control surface on which the motor-driven working member is supported. The retainer has a long arm in whose end area a counter control surface is provided against which the working member moves in a second phase, which is time-delayed relative to the first motor drive phase, during lifting of the retainer out of the rotary latch.

This door lock has proven to be successful because in the special situation the energy amounts of the motor applied successively in the first and second motor drive phases are transferred simultaneously by the shoulder onto the counter shoulder; however, manufacturing-technological and operating-related disadvantages result. The arm provided on the retainer must have a great length because of the counter control surface so that the center of gravity of the retainer is spaced at a great distance relative to its fulcrum. This requires complex manufacturing methods. Safety regulations require that the door lock in a crash situation must withstand high inertia forces, for example, inertia forces which reach 30 times the acceleration due to gravity. In order to avoid an automatic opening of the door lock, the restoring springs of such a known lock would have to be very strong. This had the result that the required actuating forces for lifting the retainer out of the rotary latch were high. The opening action of the known door lock was therefore stiff.

SUMMARY OF THE INVENTION

The invention has the object to develop a door lock of the aforementioned kind which avoids the aforementioned disadvantages. This is achieved according to the invention in that not only the control surface but also the counter control surface is provided on the storing member, in that in the special situation the required additional motor force for lifting the retainer is indirectly transmitted via the storing member onto the retainer, and in that, by doing so, the energy amounts successively applied in the two motor drive phases are then transmitted simultaneously from the shoulder of the storing member onto the counter shoulder of the retainer.

According to the invention, the control surface as well as the counter control surface are provided on the storing lever.

Accordingly, the arm on the retainer, which is to receive during release of the force storage device the released lifting force for the retainer, can be very short. Thus, the center of gravity of the retainer is very close to its fulcrum. The motor-generated lifting energy required in the special situation for lifting the retainer is also transferred from the working member onto the storing member. The energy amounts which are successively exerted in the two motor drive phases are transferred after a crash via the same locations, i.e., always from the shoulder of the storing member onto the counter shoulder of the retainer. These locations can also be very close to the fulcrum of the retainer. The restoring spring acting onto the retainer can be of a weaker design which makes possible an easy opening action.

BRIEF DESCRIPTION OF THE DRAWINGS

Further measures and advantages of the invention result from the dependent claims, the following description, and the drawings. In the drawing, the invention is illustrated by means of one embodiment. It is shown in:

DESCRIPTION OF PREFERRED EMBODIMENTS

Figure 1:
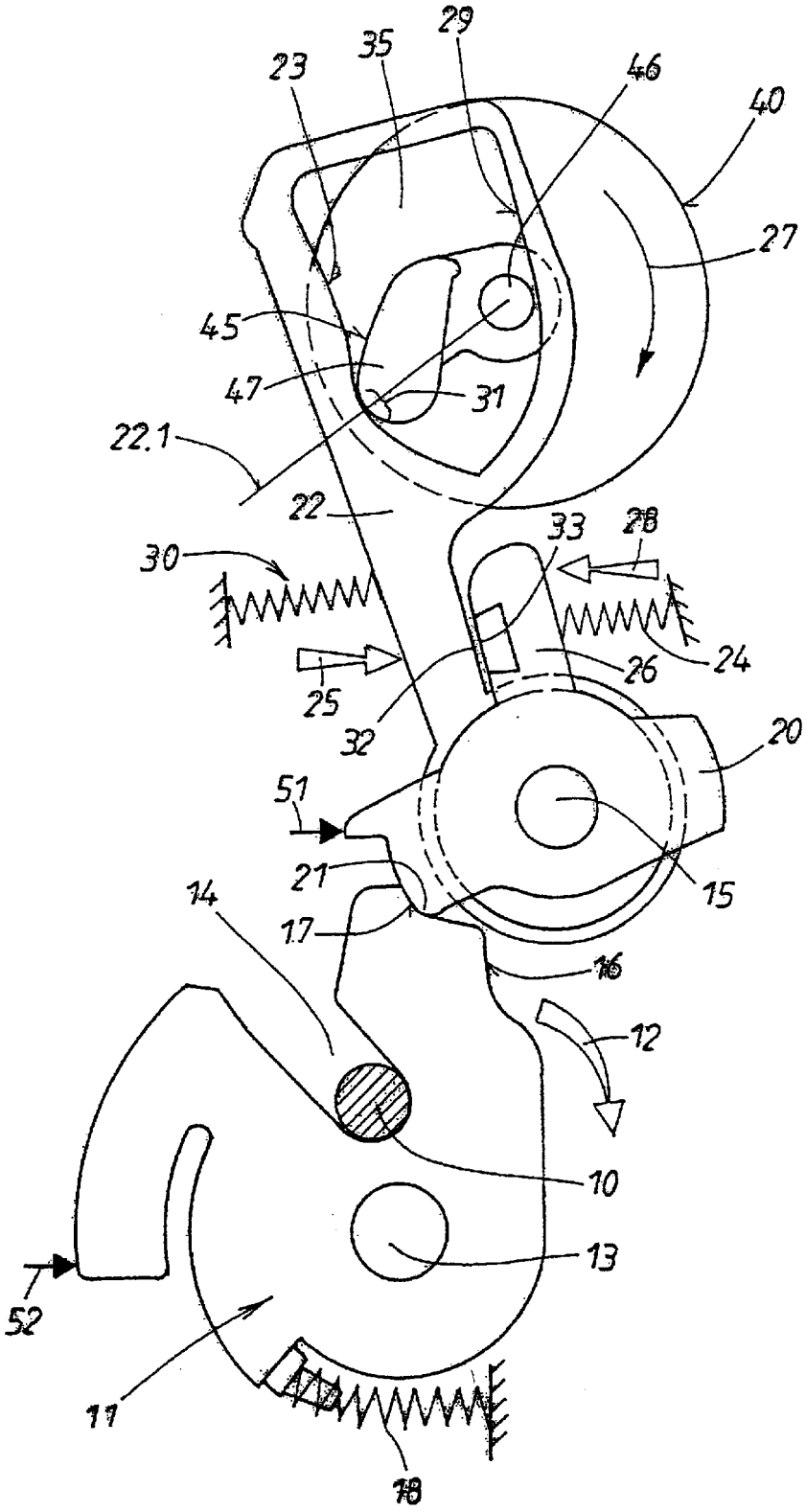
FIG. 1 the plan view onto the important components of the door lock according to the invention when the retainer is locked in the rotary latch and locks the rotary latch in its locking position.

FIG. 1 shows the initial situation in which a rotary latch 11 is locked by a locking arm 21 of a retainer 20 in its locking position. The retainer 20 is loaded in the direction of force arrow 28 by a restoring spring 24. Accordingly, in the illustrated situation the locking arm 21 is secured in the main catch 17 of the rotary latch 11. The rotary latch 11 can also have a pre-latch 16 which engages in a corresponding way the retainer 20. The rotary latch 11 has a receptacle 14 for the locking member 10 which in this embodiment is embodied only as a bolt. The retainer 20 has a fixed fulcrum 15 while the rotary latch 11 is seated on a bearing pin 13. The rotary latch 11 is itself loaded in the direction of arrow 12 by a restoring spring 18 which has the tendency to transfer the rotary latch 11 into an open position illustrated in FIG. 2.

Figure 2:
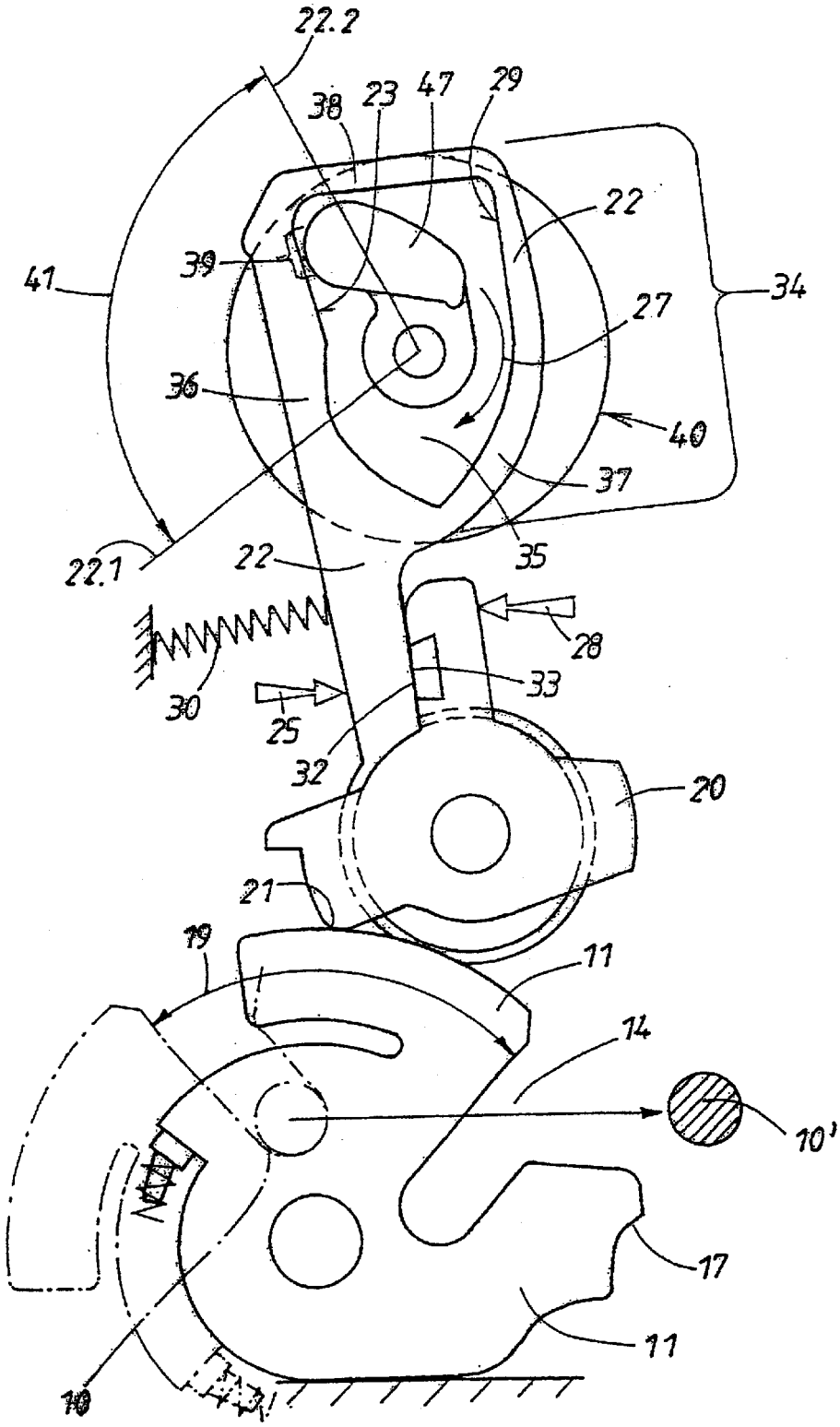
FIGS. 2 and 3 the same door lock in two further positions of the components, which positions result in the normal situation. when in an open position (FIG. 2) of the lock and (FIG. 3) again upon a return into the locking position.
Figure 3:
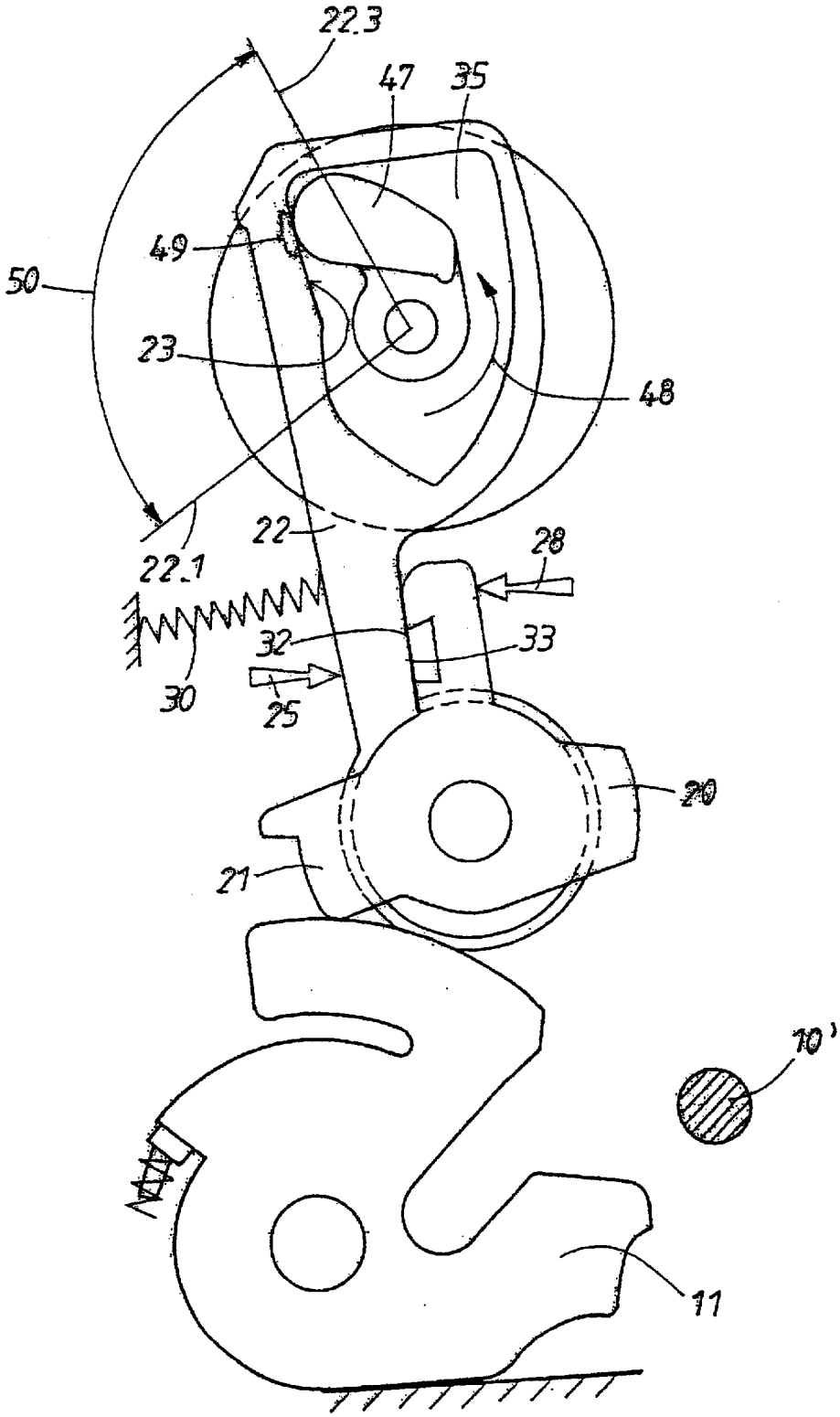

The door lock comprises also a member 22 which is loaded in the direction of arrow 25 by a force storage device 30 and is therefore referred to as "storing member". This storing member 22 could be a slide. In the present case the storing member is comprised of a lever 22 which is supported pivotably on the same fulcrum 15 as the retainer 20. This member 22 in the following will always be referred to as "storing lever"; however, it is understood that it is also possible that a member movable in a different way could be loaded by the force storage device 30. The storing lever 22 has the tendency, corresponding to the spring force 25, to attempt to reach a pivot position which is illustrated in FIG. 2 or 3. In the initial position of FIG. 1, the storing lever 22 however is prevented from doing so because it is supported by a control surface 23 provided thereat on a working member 47 which is driven, for example, by an electric motor 40.

The working member is formed as a cam which has a special contour profile 45 and is arranged at a spacing to a rotary axis 46 about which it is rotatably movable by means of a motor 40 and a transmission in the direction of arrow 27. This cam 47 secures the storing lever 22 in the initial position of FIG. 1 in a rotary position securing the fully charged state of the force storage device 30. The auxiliary line 22.1 of FIG. 1 defines the resulting rotary position which results by the action of the now active profile location 31 on the contour 45 of the cam. This profile location 31 should have the maximum radial distance from the rotary axis 46 of the cam. In the locking position of FIG. 1 the door is closed. In order to open it, an exterior and/or interior actuator, not shown, must be actuated or a signal receiving location must be triggered by a remote control. This can be realized mechanically or, as in the present case, electrically. These actuators or signal receiving locations are connected with control means which comprise two sensors and a logic control circuit. One sensor engages the rotary latch, for example, at the location identified with 51, while the other sensor monitors the angular position of the rotary latch 11 and is positioned, for example, at the location 22 in FIG. 1. When the motor 40 is supplied with current, a rotary movement of the control cam 47 in the direction of arrow 27 of FIG. 1 is caused. The storing lever 22 is released more and more because the cam glides along the control surface 23 and provides support with different further profile locations of its contour profile 45. Profile locations of the contour profile that are radially closer to the rotary axis 46 of the cam provide support. The force storage device 30 is discharged more and more.

The storing lever 22 has a shoulder 32 which has correlated therewith a counter control surface 33 on a control arm 26 belonging to the retainer 20. The spring force 25 which is released during discharging of the force storage device 30 forces the storing lever 22 with its shoulder 32 against the counter shoulder 33 on the retainer 20 and lifts it out of the main catch 17 of the rotary latch 11. Subsequently, the rotary latch 11 can then be released under the effect of the restoring force 12 acting on it into the open position illustrated in FIG. 2. The. rotary latch 11 has now been pivoted from the locking position illustrated here by a dash-dotted line into the open position, shown in a solid line, about an angle 19. The locking member has been moved out of the receptacle 14 of the rotary latch 11 and has reached its release position 10' illustrated in a solid line in FIG. 2. The aforementioned counter shoulder 33 on the retainer 20 can be reinforced by an insert of hardened material.

The storing lever 22 has a counter control surface 29 in addition to the control surface 23. This is realized in that the control lever 22 in its end area 34 has a cutout 35 which provides a division into two legs 36, 37. Even though this is not necessary, the two leg ends are connected to one another by a stay 38 so that the cutout 35 has the appearance of an "eye". The eye 35 has an elongate kidney-shaped profile. The edges of the eye 35 facing one another in the rotary direction 27 form together with a cam 47 the control and counter control surfaces 23, 29.

FIG. 2 shows the normal situation where the rotation 27 of the control cam 47 has already ended before the control cam has reached the counter control surface 29. Now the motor stops the rotation in the rotary direction 27. In FIG. 2, the lifted locking arm 21 of the retainer 20 is supported on a support surface of the rotary latch 11 provided for this purpose. The retainer 20 is maintained in a ready position. The cam 47 is supported with a second profile location 39 in another area of the control surface 23. The auxiliary line 22.2 defines at the same location as in FIG. 1 the open position of the latch 11. In comparison to FIG. 1, the cam 47 has been rotated by an angular range 41 in the rotary direction 27 in this normal situation. This movement has been realized only by discharge of the force storage device 30.

Figure 4:
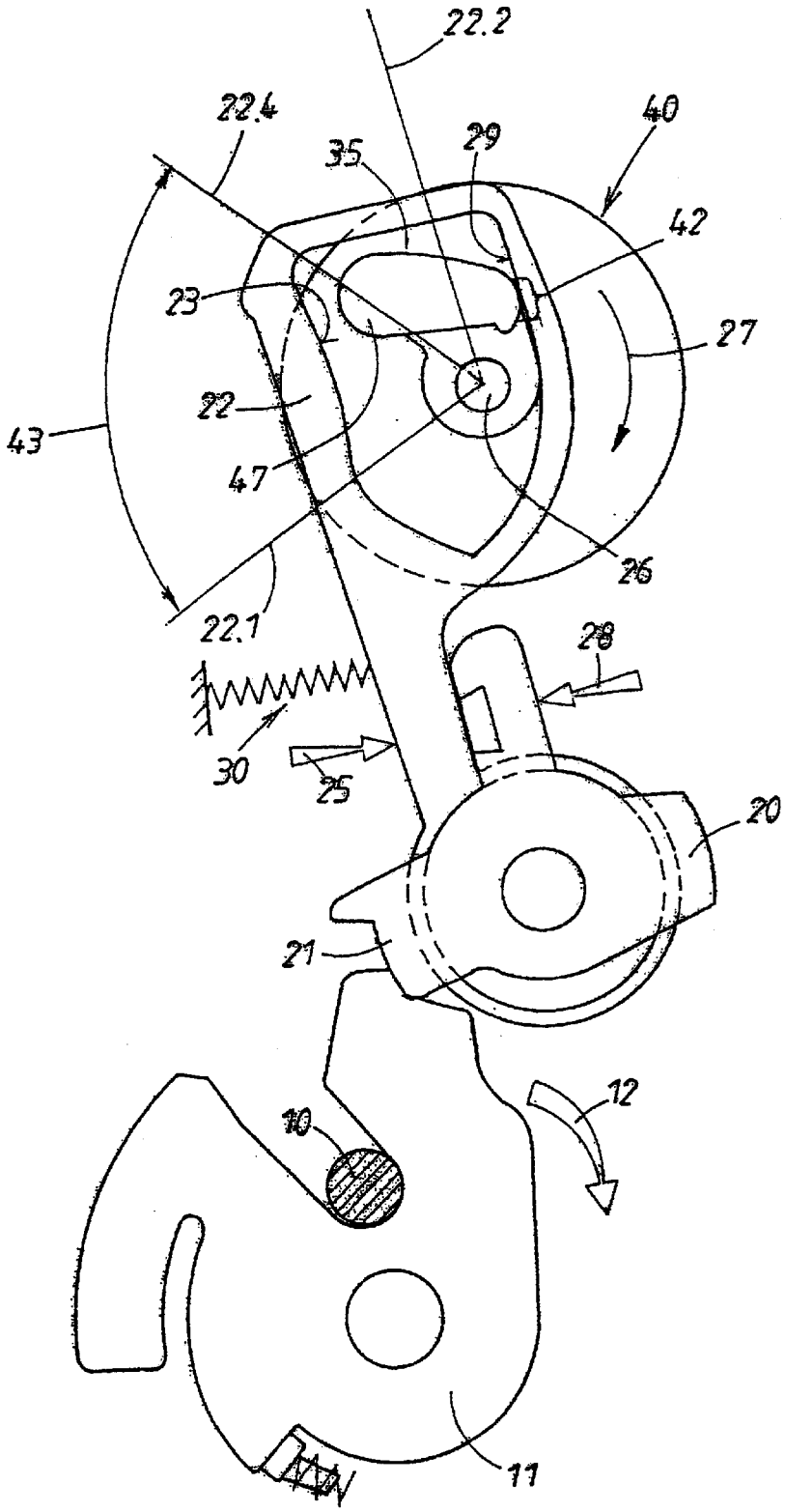
FIGS. 4 and 5 the conditions in a special situation where lifting of the retainer is made possible only with a common effort by the force storage device as well as a motor.

In the crash situation, however, or in other disturbance situations, the conditions illustrated in FIG. 4 can occur. The retainer locking arm 21 is seated so fast in the main catch 17 of the rotary latch 11 that the spring force 25 exerted by the force storage device 30 is not yet sufficient for releasing the retainer 20. This is recognized by the aforementioned sensors at 51, 52. The motor 40 then turns past the rotary position illustrated in FIG. 2 in the direction of arrow 27 and reaches first the intermediate position illustrated in FIG. 4 where the cam 47 just barely contacts the counter control surface 29 with a third profile location 42. During this contact this profile location is very close to the rotary axis 46. The cam 47 has left the control surface 23 and is in the intermediate rotary position illustrated by the auxiliary line 22.4. In FIG. 4, the cam 47 has not yet entirely completed the angle 41 illustrated in FIG. 2 but has passed only through the partial angle 43. During this movement, the energy stored within the force storage device 80 has been utilized; however, it is not sufficient, as mentioned above, to lift the retainer 20 in a crash situation.

Figure 5:
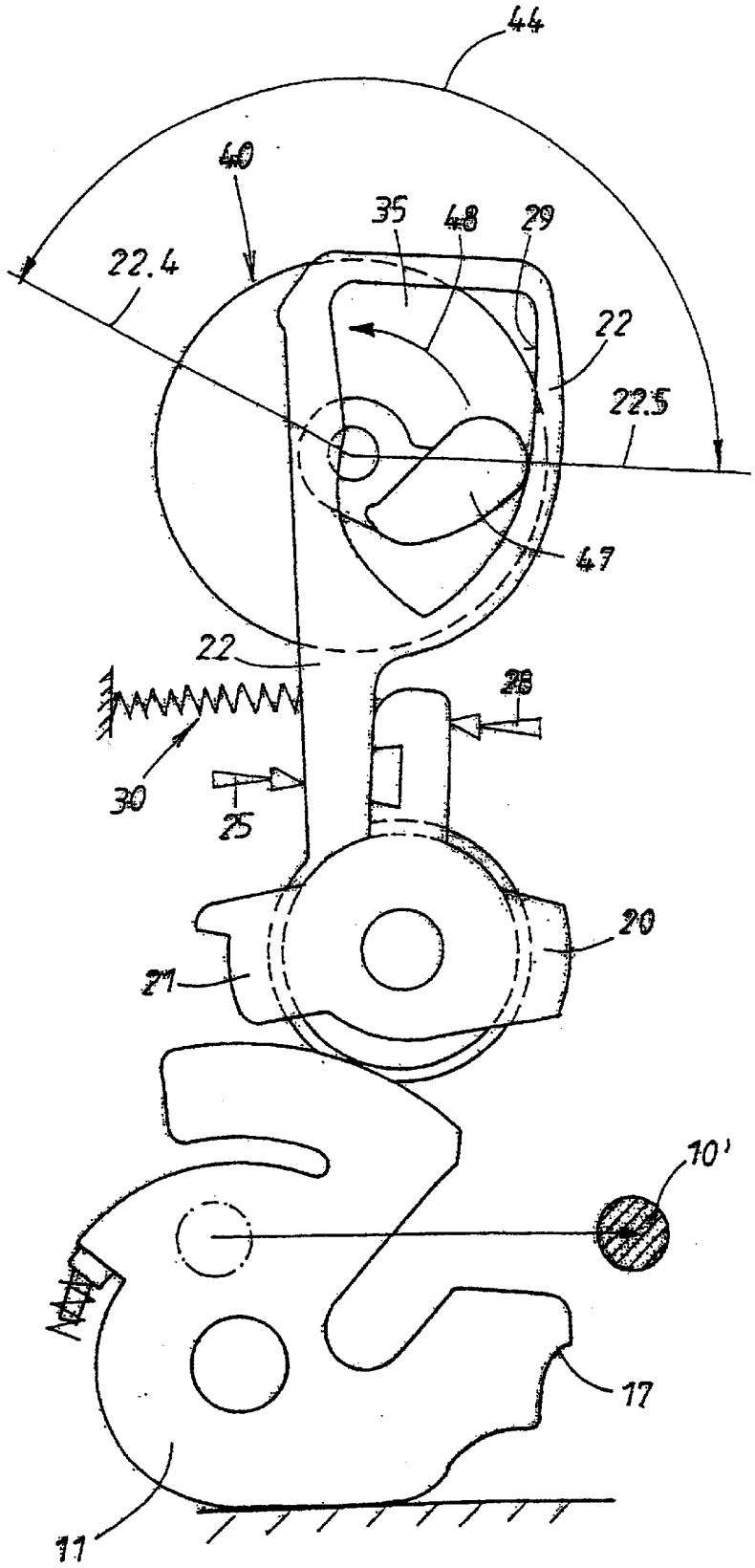

The motor 40 further rotates in the direction of arrow 27 so that the cam 47 on its further path with changing profile locations in the eye 35 glides along changing areas of the counter control surface 29. Finally, the position illustrated in FIG. 5 is reached where the control cam 27 has reached a rotary end position which is illustrated by the auxiliary line 22.5. Along the travel path between FIGS. 4 and 5, an angular range 44 results where the cam 47 is driven directly by the motor 40. During this residual rotation the spring force of the force storage device 30 is added to the driving force of the motor 20. This is sufficient in order to release the retainer locking arm 21, as shown in FIG. 5, from the main catch 17 of the rotary latch 11. It then reached under the effect of the restoring force 12 its rotary stop, as already mentioned in connection with FIG. 2. The closure part is then in its release position 10'.

After lifting of the retainer 20 in a disturbance situation according to FIG. 5 or in the normal situation according to FIG. 2, the cam 47 could move farther in the interior of the eye 35 in the same rotary direction 27 up to the initial position of FIG. 1; however, in this embodiment the motor 40 is stopped by the aforementioned logic control circuit which is again detected by the sensors, for example, at 51, 52. Then the motor 40 changes its direction of rotation in the direction of counter rotation arrow 48. For this purpose it is sufficient to supply the motor 40 with reverse current. The cam 47 impacts during this return rotation 48 on the control surface 23 positioned oppositely within the eye or the cutout 35 and moves the control or storing lever 22 again into the initial position illustrated in FIG. 1.

During this return movement 48, the cam 47 reaches the intermediate position illustrated in FIG. 3, which is marked therein by the corresponding auxiliary line 22.3, wherein a fourth profile location 49 of the cam contour for the first time comes into contact with the control surface 23. Upon further return rotation 48 the storing lever 22 is moved counter to the spring force 25 so that the force storage device 30 is again recharged. Recharging of the force storage device 30 is realized within the angular range identified in FIG. 3 by 50. The charging at 50 is thus carried out in a different motor drive phase than the discharge of the force storage device 30.

The latter in the normal situation is illustrated by the angular range 41 in FIG. 2. The forces which in both motor drive phases at 41, on the one hand, and at 50, on the other hand, are successively applied are transferred between the two components 20, 22 in a disturbance situation by means of the same contact locations, i.e., the shoulder 32 and the counter shoulder 33. The storing lever 22 serves as an opening aid for lifting the retainer in the normal situation as well as in the disturbance situation.

As has been mentioned already, according to the invention a unitary configuration of the control surface 23 with the counter control surface 29 is present. Both are located on the storing lever 22. The contour 45 of the control cam is drop-shaped wherein its profile can be of an asymmetric configuration at the radially outer side in comparison to the oppositely positioned inner cam side relative to the rotary cam axis 46. The corresponding edge contours of the surfaces 23, 29 are profiled with a corresponding counter profile. Because the retainer 20 has only a short control arm 26 which must not support a large counter surface 29, its center of gravity is very close to its fulcrum 15. Inertia forces which results in a crash situation are therefore minimal. It is no longer possible that an undesirable automatic lifting of the retainer 20 could occur. Accordingly, without further measures a safety range up to more than 30 times the acceleration of the fall is achieved. This short configuration results because the counter control surface 29 no longer belongs to the retainer. For this reason, the restoring spring 24 of the retainer illustrated in FIG. 1 can be of a weaker configuration. This, in turn, has the result that the required actuation forces for lifting the locking retainer 20 out of the rotary latch 11 become lower. Opening is thus made easier.

List of Reference Numerals:

| | |
|---|---|
| 10 | locking member |
| 10' | release position of 10 |
| 11 | rotary latch |
| 12 | arrow of restoring force of 11 |
| 13 | bearing pin of 11 |
| 14 | receptacle in 11 for 10 |
| 15 | fulcrum for 20 |
| 16 | pre-catch of 11 |
| 17 | main catch of 11 |
| 18 | restoring spring for 11 |
| 19 | pivot angle of 11 (FIG. 2) |
| 20 | retainer |
| 21 | locking arm of 20 |
| 21.1 | auxiliary line for 47 in the locking position (normal situation) |
| 21.2 | auxiliary line for 47 in the open position (normal situation) |
| 21.3 | auxiliary line for 47 at the beginning of charging (normal situation) |
| 21.4 | auxiliary line for 47 in an intermediate rotary position (in a crash situation) |
| 21.5 | auxiliary line for 47 in final rotary position (in a crash situation) |
| 22 | storing member, storing lever |
| 23 | control surface on 22 |
| 24 | restoring spring for 20 |
| 25 | arrow of spring force on 30 |
| 26 | control arm of 20 |
| 27 | arrow of rotary movement of 47 during releasing |
| 28 | arrow of spring load of 20 |
| 29 | counter control surface on 22 for 47 in the crash situation |
| 30 | storage device |
| 31 | first profile location of 47 |
| 32 | shoulder on 22 |
| 33 | counter shoulder on 20 |

-continued

List of Reference Numerals:

| | |
|---|---|
| 34 | plane end area of 22 |
| 35 | cutout in 22, eye |
| 36 | first leg of 34 (FIG. 2) |
| 37 | second leg of 34 (FIG. 2) |
| 38 | connecting stay between 36, 37 (FIG. 2) |
| 39 | second profile location of 47 |
| 40 | motor, optionally with transmission |
| 41 | angle area during discharge of 30 (FIG. 2) |
| 42 | third profile location of 47 |
| 43 | partial angle of discharge (FIG. 4) |
| 44 | angle area for motor-driven opening in a crash situation (FIG. 5) |
| 45 | contour profile of 47 |
| 46 | rotary axis of 47 |
| 47 | working member, cam |
| 48 | arrow of counter rotation of 47, return rotation (FIGS. 3, 5) |
| 49 | fourth profile location of 47 |
| 50 | angle area for charging (FIG. 3) |
| 51 | engagement location of the first sensor at 11 |
| 52 | engagement location of the second sensor at 20 |

What is claimed is:

1. A door lock for a door of a motor vehicle, the door lock comprising:

a rotary latch (11) having a main catch (17);

a locking member (10) configured to be introduced into the rotary latch (11) during closing of a door of a motor vehicle and to pivot the rotary latch (11) from an open position into at least one locking position;

a spring-loaded (28) retainer (20) configured to engage in one of the at least one locking positions the main catch (17), wherein the retainer (20) has a counter shoulder (33);

a working member (47) configured to indirectly lift the retainer (20);

a motor (40) acting on the working member (47);

a storing member (22) having a control surface (23) and a counter control surface (29);

a force storage device (30) loading the storing member (22), wherein the storing member (22) has a shoulder (32) configured to contact the counter shoulder (33) for lifting the retainer (20) away from the main catch (17) by discharging the force storage device (30);

wherein the motor (40) has a first motor drive phase for moving the working member (47) in order to charge the force storage device (30);

wherein the motor (40) has a second motor drive phase for moving the working member (47) against the counter control surface (29) during lifting of the retainer (20) out of the main catch (17), wherein the second motor drive phase is time-delayed relative to the first motor drive phase;

wherein, in a crash situation, forces of the motor (40) applied successively in the first and second motor drive phases onto storage device are used for lifting the retainer (20);

wherein, in a disturbance situation, an additionally required force of the motor for lifting the retainer (20) is indirectly transmitted via the storing member (22) onto the retainer (20) so that the forces successively applied in the first and second motor drive phases are transmitted simultaneously from the shoulder (32) of the storing member (22) onto the counter shoulder (33) of the retainer (20).

2. The door lock according to claim 1, wherein the storing member is a storing lever (22) pivotably supported coaxially relative to the retainer (20), and wherein the retainer (20) has an arm provided with the counter shoulder (33) and wherein the storing lever (22) has a second arm provided with the control surface (23), wherein the arm of the retainer (20) is shorter than the arm of the storing lever (22).

3. The door lock according to claim 2, wherein the storing lever (22) has a cutout (35) engaged by the working member (47).

4. The door lock according to 3, wherein the cutout (35) is located in a substantially planar area (34) of the storing member or storing lever (22) and wherein oppositely positioned sides of the cutout (35) form the control surface (23) and the counter control surface (29) for the working member (47) positioned between the control surface and the counter control surface, wherein the working member is rotatable about an axis of rotation (46).

5. The door lock according to claim 4, wherein the storing lever (22) has at least one partial member (34) divided into two legs (36, 37) which enclose the cutout (35).

6. The door lock according to claim 5, wherein the two legs (36, 37) are not connected to one another and impart a fork shape to the storing lever (22).

7. The door lock according to claim 5, wherein the two legs (36, 37) are connected to one another by a stay (38) so that the cutout has an elongate profile.

8. The door lock according to claim 7, wherein the cutout has an elongate oval shape and wherein oppositely positioned edges of the oval shape, viewed in the pivoting direction of the storing lever, form the control surface (23) and the counter control surface (29).

9. The door lock according to claim 8, wherein the working member comprises a profiled elongate cam (47) and wherein the cam is radially displaced relative to the axis of rotation (46).

10. The door lock according to claim 9, wherein the cam (47) has a drop-shaped profile.

11. The door lock according to claim 10, wherein the drop-shaped profile is asymmetric.

12. The door lock according to claim 9, wherein the cam (47) has a cam profile matching a profile of the edges of the cutout (35) and, as a function of operational states of the door lock and a rotary angle of the cam (47), contacts different profile locations (31, 39, 42, 49), radially displaced relative to the axis of rotation (46), of the profile of the edges (23; 29) of the storing lever (22).

13. The door lock according to claim 3, wherein the working member (47) rotates in the same direction during charging and discharging of the force storage device (30).

14. The door lock according to claim 3, wherein the working member during charging (50) of the force storage device (30) is rotationally driven in a rotational direction (48, 49) opposite to a rotational direction during discharging of the force storage device (41) between profile edges of the cutout (35).

15. The door lock according to claim 1, further comprising control means for recognizing a position of the door, wherein the control means comprise sensors (51; 52) and a logic control circuit connected to the sensors.

16. The door lock according to claim 15, wherein a first one of the sensors responds directly or indirectly to a certain position of the rotary latch and wherein a second one of the sensors (51) responds to a position defined by the retainer (20) engaging the main catch (17) or a pre-catch (16) of the rotary latch (11).

* * * * *